US006608273B2

(12) United States Patent
Watanabe et al.

(10) Patent No.: US 6,608,273 B2
(45) Date of Patent: Aug. 19, 2003

(54) PUSH SWITCH

(75) Inventors: Hisashi Watanabe, Okayama (JP); Hiromichi Koyama, Okayama (JP); Koji Sako, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/111,058

(22) PCT Filed: Aug. 7, 2001

(86) PCT No.: PCT/JP01/06773

§ 371 (c)(1),
(2), (4) Date: Jul. 17, 2002

(87) PCT Pub. No.: WO02/17340

PCT Pub. Date: Feb. 28, 2002

(65) Prior Publication Data

US 2003/0015411 A1 Jan. 23, 2003

(30) Foreign Application Priority Data

Aug. 22, 2000 (JP) ..... 2000-250646

(51) Int. Cl.[7] ..... H01H 5/18
(52) U.S. Cl. ..... 200/406; 200/5 A
(58) Field of Search ..... 200/5 A, 5 R, 200/283, 284, 512–517, 406

(56) References Cited

U.S. PATENT DOCUMENTS

| | | | | |
|---|---|---|---|---|
| 5,578,802 A | | 11/1996 | Palmowski | |
| 5,671,841 A | * | 9/1997 | Glasson | 200/406 |
| 5,842,561 A | | 12/1998 | Takahashi | |
| 5,895,901 A | | 4/1999 | Watanabe et al. | |
| 6,492,602 B2 | * | 12/2002 | Asai et al. | 200/1 B |
| 6,518,527 B2 | * | 2/2003 | Watanabe et al. | 200/406 |

FOREIGN PATENT DOCUMENTS

| | | |
|---|---|---|
| JP | 60-57025 | 4/1985 |
| JP | 02-106642 | 8/1990 |
| JP | 07-254327 | 10/1995 |
| JP | 11-265634 | 9/1999 |

* cited by examiner

*Primary Examiner*—Elvin Enad
*Assistant Examiner*—Lisa Klaus
(74) *Attorney, Agent, or Firm*—RatnerPrestia

(57) ABSTRACT

A thin push switch used in a portable electronic apparatus includes a less number of components jointed together without any adhesive controlled hardly, and can thus be favored with mass production. The push switch includes an insulating spacer having first cramp-locked tabs cramp-locked with the first terminals of a fixed plate and second cramp-locked tabs cramp-locked with the second terminals of a contact plate. The fixed plate includes a fixed contact, and the contact plate includes a movable contact. Accordingly, the contact plate, the insulating spacer, and the fixed plate can be joined together without an adhesive.

8 Claims, 5 Drawing Sheets

PUSH SWITCH

TECHNICAL FIELD

The present invention relates to a thin push switch used in a portable electronic device such as a mobile telephone or a portable headphone stereo player.

BACKGROUND ART

As portable electronic apparatuses have been having a reduced size or thickness, downsizing of push switches in the device is significantly desired. A conventional push switch having a reduced size or thickness for optimum downsizing is disclosed in Japanese Patent Laid-open No.7-254327, and will be explained below referring to the relevant drawings.

FIGS. 8 and 9 are a perspective view and an exploded perspective view of the conventional push switch, respectively. A bottom metal plate 1 of the push switch has a fixed contact 2 provided on the center thereof, and also has first external terminals 1A formed on one edge thereof which are downwardly bent in an L-shape. The metal plate 1 has notches 1B formed at the opposite edge thereof having a specific width. An adhesive insulating sheet 3 having both surfaces thereof coated with an adhesive agent is bonded at the lower side with the adhesive agent to the upper side of the bottom metal plate l. The adhesive insulating sheet 3 has a center opening 3A formed therein. Upon being bonded to the bottom metal plate 1, the bottom metal plate 1 has a center contact 2 positioned a center of the center opening 3A, and has an upper end of the center contact exposed upward through the center opening 3A. The adhesive insulating sheet 3 includes notches 3B formed corresponding to the notches 1B formed at the other edge of the bottom metal plate 1. The adhesive insulating sheet 3 is bonded with an elastic metal plate 4 at the upper side thereof with the adhesive agent. The elastic metal plate 4 includes a dome-shaped projection 5 swelling upward at the center of the plate 4. The lower side of the projection 5 is positioned opposite to and spaced from the fixed contact 2 at the center of the plate 1. The elastic metal plate 4 has second external terminals 4A formed with bent downward in an L-shape. The second external terminals 4A extend downward through the notches 3B of the adhesive insulating sheet 3 and the notches 1B of the bottom metal plate 1 with being electrically isolated from the bottom metal plate 1.

An operation of the conventional push switch will be explained. Upon being depressed downward with a pressure, the dome-shaped projection 5 of the elastic metal plate 4 has the dome shape inverted with a click feel, and has the lower side directly contacts with the fixed contact 2 of the bottom metal plate 1. This allows the elastic metal plate 4 and the bottom metal plate 1 to electrically conducts to each other, thus turning on the switch, i.e. the first external terminals 1A and the second external terminals 4A conducts to each other. Upon being released from the pressure, the dome-shaped projection 5 can return back to the original shape by an own elasticity, thus electrically disconnecting between the bottom metal plate 1 and the elastic metal plate 4 and turning off the switch.

The conventional push switch includes the bottom metal plate 1 and the elastic metal plate 4 bonded to each other with the adhesive agent of the adhesive insulating sheet 3. It is however difficult to control and maintain the thickness and adhesivity of the adhesive agent coated on both sides of the adhesive insulating sheet 3, and hence, extra steps for adjustment in the production of the switch is required.

DISCLOSURE OF THE INVENTION

A thin push switch includes a less number of components joined together without adhesive, causing a trouble, in the handling, and can thus be favored with mass production.

The push switch includes the following elements:

(A) A fixed plate including a fixed contact at the center thereof, first cramp-locking sections respectively provided at a pair of first ends opposite to each other, and a first terminal electrically connected with the fixed plate;

(B) A contact plate, which faces the fixed plate, including a movable contact facing the fixed contact, second cramp-locking sections respectively provided at a pair of second ends opposite to each other which are disposed at different positions from the first opposite ends of the fixed plate, and second terminals electrically connected with the movable contact; and (C) An insulating spacer, which is disposed between the fixed plate and the contact plate, including first cramp-locked tabs being positioned corresponding to the first ends and cramp-locked by the first cramp-locking sections, second cramp-locked tabs being positioned corresponding to the second ends and cramp-locked by the second cramp-locking sections, and an opening facing the fixed contact.

BEST MODES FOR CARRYING OUT THE INVENTION

Figure 1:
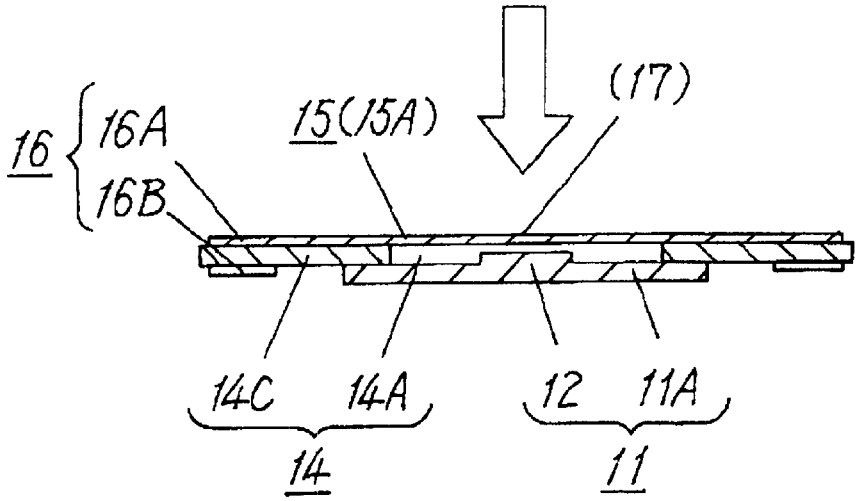
FIG. 1 is a side cross sectional view of a push switch according to an exemplary embodiment of the present invention.
Figure 2:
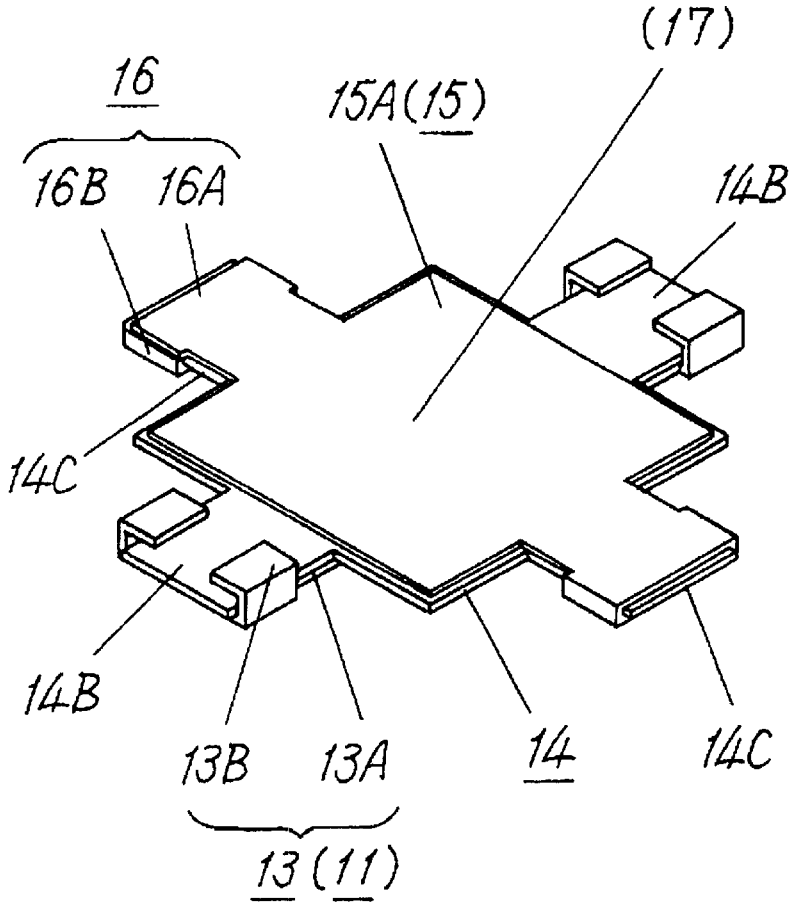
FIG. 2 is a perspective view of the push switch according to the embodiment.
Figure 3:
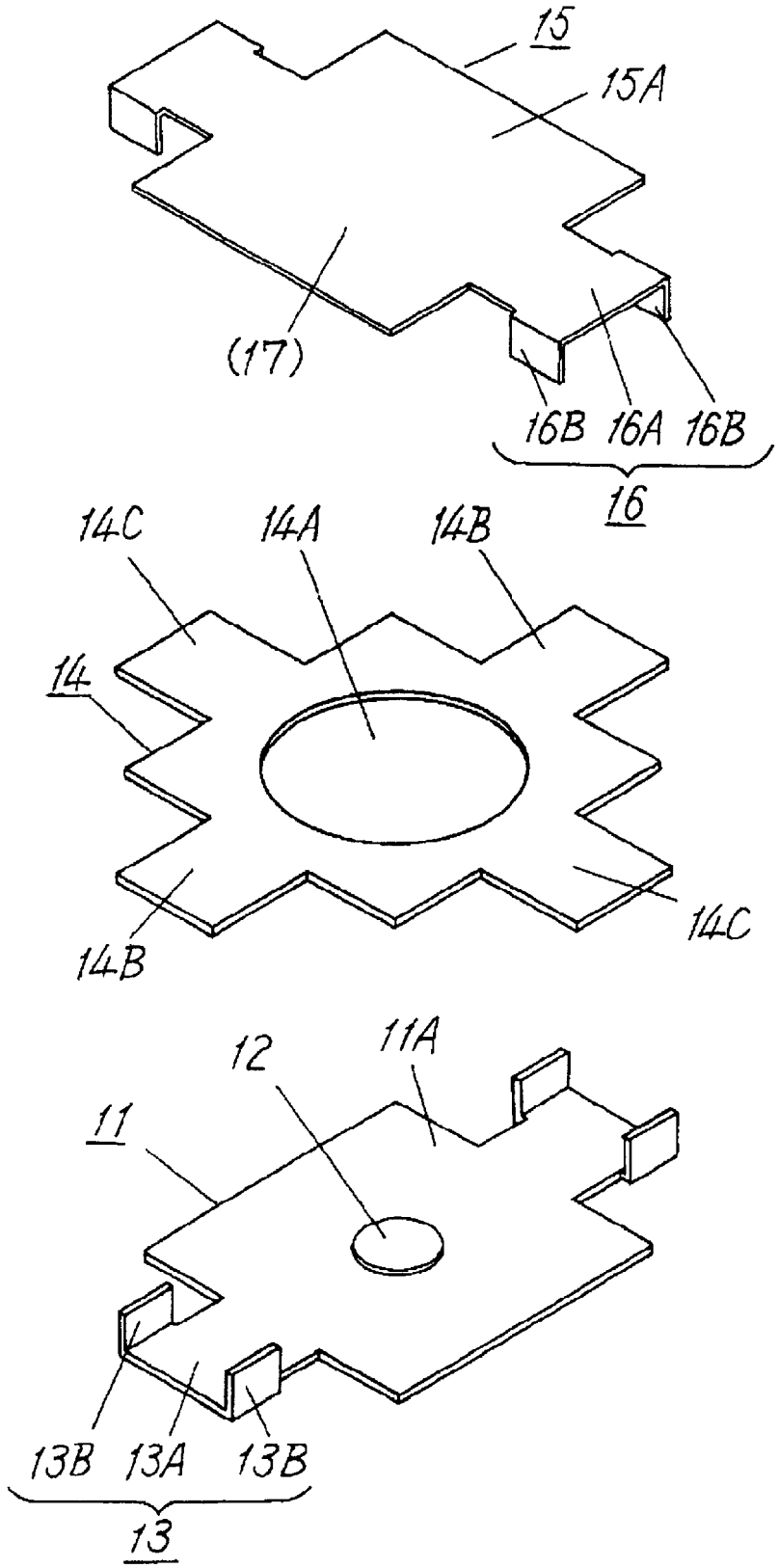
FIG. 3 is an exploded perspective view of the push switch being not assembled according to the embodiment.

FIG. 1 is a cross sectional side view of a push switch according to an exemplary embodiment of the present invention. FIG. 2 is a perspective view of the assembled push switch. FIG. 3 is an exploded perspective view of the push switch which is not assembled.

A fixed plate 11 made of a metal has a fixed contact 12 projecting upward provided at the center of a bottom portion 11A substantially shaped in square. The fixed plate 11 includes a pair of first terminals 13 extending outward from two opposite edges of the bottom portion 11A. As shown in FIG. 3, each first terminal 13 is arranged in a squared U-shape upwardly opening. The terminal 13 includes a first extension 13A of a specific width being formed unitarily with the bottom portion 11A and extending horizontally from the edge of the bottom portion 11A, and a couple of first cramp-locking tabs 13B bent upward from both sides of the first extension 13A.

An insulating spacer 14 is provided to overlap the fixed plate 11. The spacer is made of heat-resistant insulating resin material and shaped substantially in square which is equal to or slightly greater than the size of the bottom portion 11A. As both are overlapped, the fixed contact 12 is exposed through an opening 14A provided at the center of the insulating spacer 14. The insulating spacer 14 includes first cramp-locked tabs 14B respectively extending horizontally from two opposite ends of the square shape about the opening 14A. The width of the first cramp-locked tab 14B is substantially equal to or slightly smaller than that of the first extension 13A of the first terminal 13. The length of the first cramp-locked tab 14B is slightly greater than that of the first extension 13A. The insulating spacer 14 has second cramp-locked tabs 14C respectively extending horizontally from two other opposite ends of the square shape about the opening 14A. The line extending across the first cramp-locked tabs 14B is designated at substantially a right angle to the line extending across the second cramp-locked tabs 14C. The insulating spacer 14 is jointed to the fixed plate 11 through having the first cramp-locked tabs 14B put on the first sections 13 and cramp-locked by the first cramp-locking tabs 13B of the fixed plate 11.

A contact plate 15 made of an elastic metal plate includes a top portion 15A sized generally identical to the bottom portion 11A of the fixed plate 11. The contact plate 15 includes a pair of second terminals 16 respectively extending outward from two opposite edges of the top portion 15A. More specifically, the contact plate 15 is placed over the insulating spacer 16, so that the line extending across the second terminals 16 may intersect substantially at a right angle to the line extending across the first terminals 13. As shown in FIG. 3, each second terminal 16 is arranged a squared U-shape opening downward. The terminal 16 includes a second tab 16A of a specific width extending horizontally from the edge of the top portion 15A and a couple of second cramp-locking tabs 16B bent downward from both sides of the second tab 15A. The width of the second cramp-locked tab 14C is generally equal to or slightly smaller than that of the second tab 16A of the second terminal 16. The length of the second cramp-locked tab 14C is slightly greater than that of the second tab 16A. The insulating spacer 14 is jointed to the contact plate 15 through having the second cramp-locked tabs 14C, which are not cramp-locked with the first terminals 13, put directly from below the second terminals 16 and cramp-locked by the second cramp-locking tabs 16B of the contact plate 15.

While the fixed plate 11, the insulating spacer 14, and the contact plate 15 are jointed together to be a single assembly, a portion of the contact plate 15 corresponding to the opening 14A of the insulating spacer 14, i.e., a center of the top portion 15A opposite to the fixed contact 12 of the fixed plate 11 operates as a movable contact 17 of the push switch.

An operation of the push switch according to the embodiment will be described below.

While the movable contact 17 of the contact plate 15 is not depressed, as shown in FIG. 1, the lower side of the contact 17 is spaced from the fixed contact 12 by the insulating spacer 14, hence leaving the push switch turned off.

Figure 4:
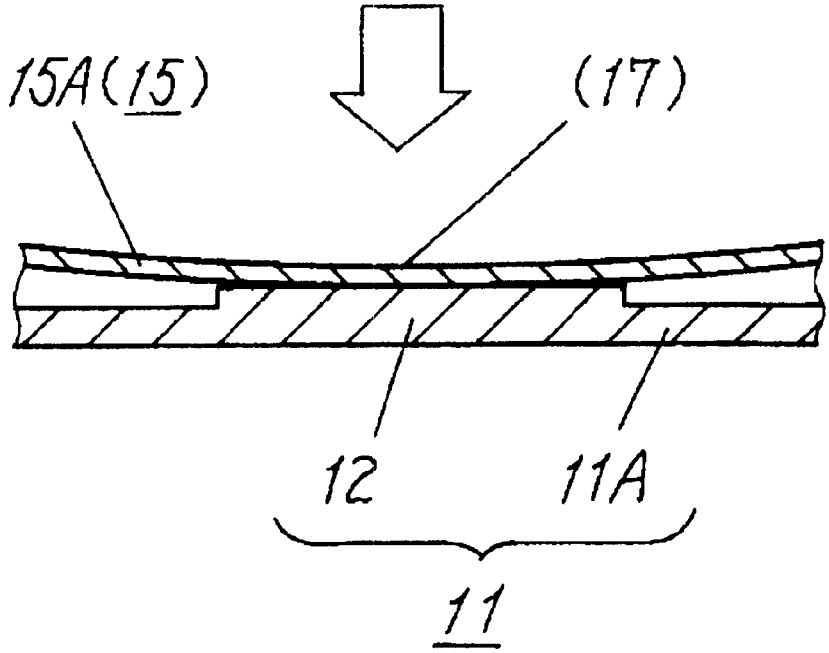
FIG. 4 is a partially enlarged cross sectional view of a fixed contact and a movable contact of the push switch in its operation according to the embodiment.

When the movable contact 17 or the center of the top portion 15A of the contact plate 15 is pressed down as denoted by an arrow mark of FIG. 1 and deflected downward with elastic deformation, the lower side of the contact 17 directly contacts with the fixed contact 12. FIG. 4 illustrates the movable contact 17 pressed down and held directly contacting with the fixed contact 12. As a result, the push switch is turned on with the first terminal 13 conducted to the second terminal 16.

Then, when the depressing action is canceled, the contact plate 15 returns back to the original position with an elasticity of the plate 15 as shown in FIG. 1. As the movable contact 17 has been isolated from the fixed contact 12, the push switch is turned off.

The push switch according to the embodiment has the insulating spacer 14 jointed by cramp-locking to the fixed plate 11 and the contact plate 15. This requires no adhesive agent which may be cause trouble during being handled and a less number of steps for checking the cramp-locked portions.

In addition, the process of assembling the push switch includes aligning the fixed plate 11 and the contact plate 15 together with reference to the insulating spacer 14 and joining them together by simply cramp-locking, thus enabling the switch to be mass-manufactured continuously easily.

Figure 5:
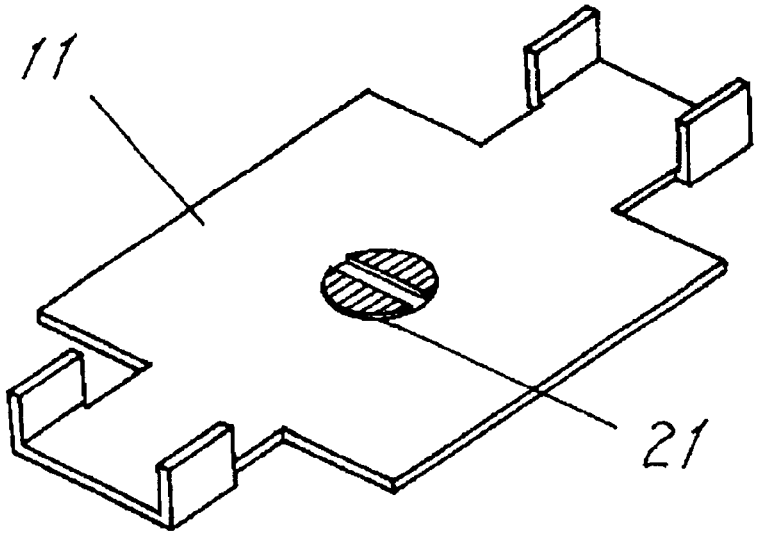
FIG. 5 is a perspective view of a fixed plate having a knurl of the push switch of the embodiment.
Figure 6:
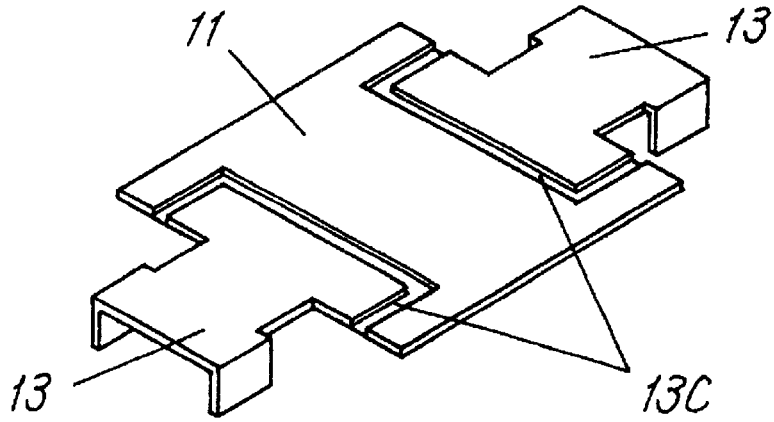
FIG. 6 is a back view of a fixed plate having a recess of the push switch according to the embodiment.

As shown in FIG. 5, the fixed plate 11 may includes the fixed contact 21 having a knurl at the top thereof for increasing the number of contact points and for improving steadiness of contact between the fixed contact 21 and the lower side of the movable contact 17 of the contact plate 15. The knurl prevents the fixed contact 21 from any tiny particles of dust in a recess and prevents the switch from being stuffed between the contacts, thus contributing to an highly steady, reliable operation of the push switch.

Alternatively, the fixed plate 11 may include a pattern of grooves 13C surrounding the first terminals. The grooves 13C are provided on the lower side, on which the switch is mounted to a printed circuit board (PCB). The grooves 13C allows the push switch to have an enhanced operational steadiness and reliability as receiving a flux for the process of mounting the push switch to the PCB.

Even if the flux moves into a space between the fixed plate 11 and insulating spacer 14 or between the contact plate 15 and insulating spacer 14, the flux can stop at the edge of the opening 14A provided in the insulating spacer 14 by a surface tension of the flux.

Once the flux is cured between the fixed plate 11 and insulating spacer 14 or between the contact plate 15 and insulating spacer 14, the flux securely bonds the plates thus increasing the joining strength between the plates during the mounting process.

The contact plate 15 may be covered at the upper side thereof with an insulating film when the push switch is installed at a specific location where a static electricity is inevitable. The insulating film protects the push switch from the static electricity, thus increasing the operational reliability of the switch.

Figure 7:
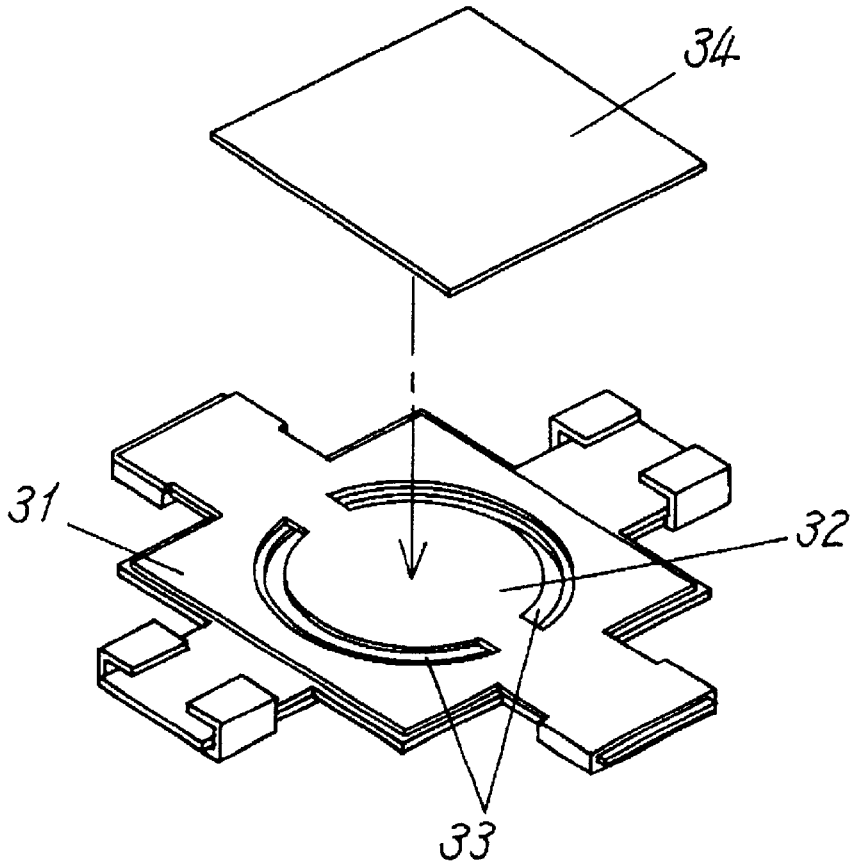
FIG. 7 is a perspective view of the push switch including a contact plate having a movable contact according to the embodiment.
Figure 8:
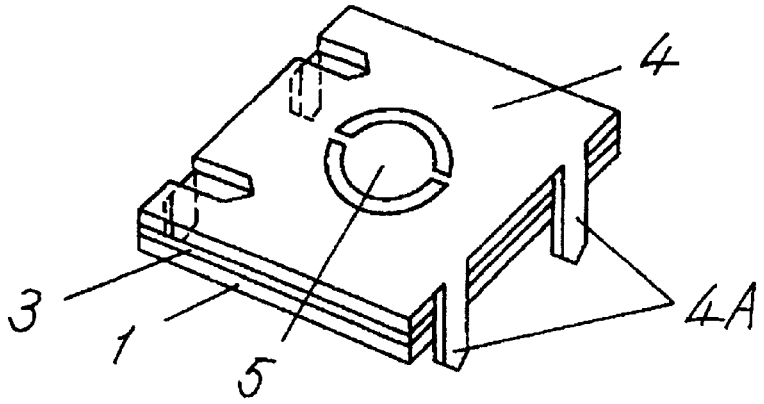
Fig. 8 Prior Art
FIG. 8 is a perspective view of a conventional push switch.
Figure 9:
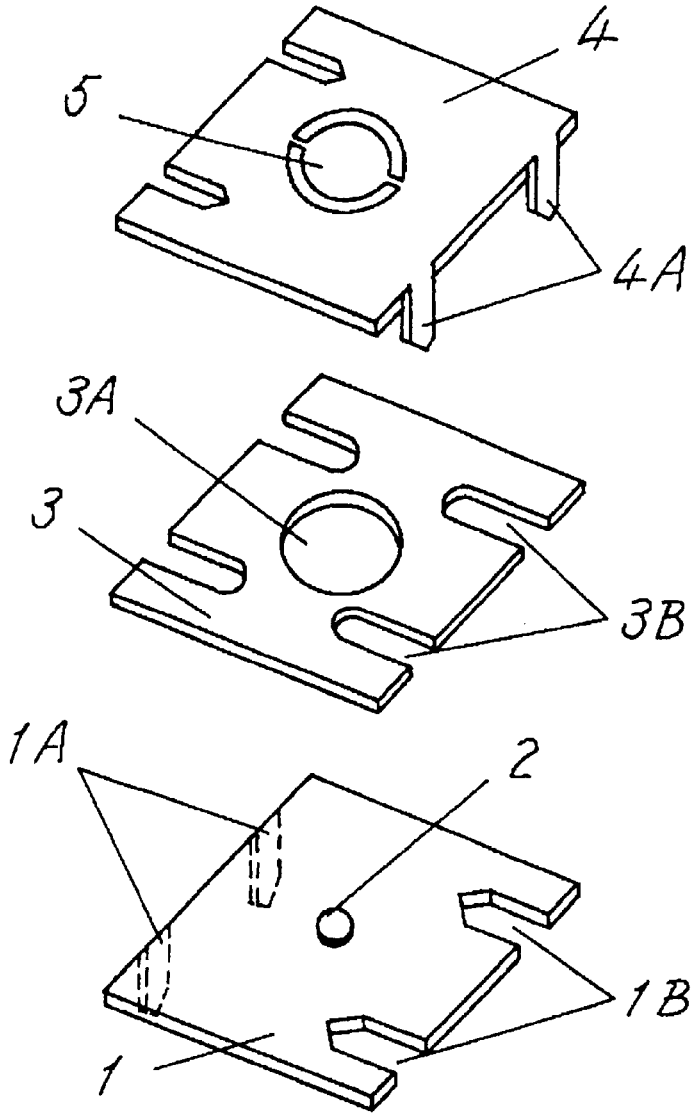
Fig. 9 Prior Art
FIG. 9 is an exploded perspective view of the conventional push switch.

FIG. 7 is a perspective view of a modification of the push switch. The switch includes a contact plate 31 including a movable contact 32 formed in a dome-shape expanding upward provided at the center of the contact 32. The movable contact 32 is inverted in the shape by a pressing operation. Therefore, the switch may be turned on with a click feel.

Also, as shown in FIG. 7, the dome-shaped movable contact 32 may be surrounded by slits 33. This reduces the joints between the movable region and the non-movable region. Accordingly, the contact plate 31 can be prevented from a load applied to the inverted movable contact 32 in the shape. This allows an operator to feel the click more clearly. The slit 33 may be replaced by an aperture with the same effect.

Moreover, upon including the slits or apertures, the contact plate 31 may be accompanied with an insulating film 34 applied over the upper side of the plate 31 for reducing an influence of a static electricity. This prevents any matter from entering and fouling the contact of the switch, thus avoiding malfunction of the switch.

The fixed plate, the contact plate, and the insulating spacer of the push switch are not limited to a square shape but may be arranged of any appropriate shape such as a round shape.

The switch above-described includes the first cramp-locking sections operating as the first tab of the fixed plate and the second cramp-locking sections operating as the second tab of the contact plate. They may be arranged separately. More specifically, the fixed plate may include first terminals and first cramp-locking sections provided separately at two opposite ends the plate, respectively. Similarly, the contact plate may include second terminals and second cramp-locking sections provided separately at two opposite ends the plate, respectively.

INDUSTRIAL APPLICABILITY

As set forth above, a thin push switch according to the present invention has a reduced number of components joined to each other by simply cramp-locking. The push switch, since being efficiently assembled by an unelaborate step of cramp-locking, can be favored with mass production. The push switch thus has an improved performance and reduced in the cost.

What is claimed is:

1. A push switch comprising:

a fixed plate including:

a fixed contact provided at a center thereof;

first cramp-locking sections provided at a pair of first ends opposite to each other thereof; and a first terminal electrically connected with said fixed plate;

a contact plate facing said fixed plate, including:

a movable contact provided at a location facing said fixed contact;

second cramp-locking sections provided at a pair of second ends opposite to each other thereof, said second ends being at different positions from said first ends; and a second terminal electrically connected with said movable contact; and an insulating spacer disposed between said fixed plate and contact plate, said insulating spacer having an opening formed at a position facing said fixed contact, said insulating spacer including:

first cramp-locked tabs located at said first ends and cramp-locked by said first cramp-locking sections; and second cramp-locked tabs located at said second ends and cramp-locked by said second cramp-locking sections.

2. A push switch according to claim 1, wherein said first terminal is provided unitarily with said first cramp-locking sections.

3. A push switch according to claim 1, wherein said second terminal is provided unitarily with said second cramp-locking sections.

4. A push switch according to claim 1, wherein said fixed contact includes a knurl provided on a first side thereof facing said movable contact.

5. A push switch according to claim 1, wherein said fixed plate having a recess formed on a second side thereof near said first terminal, said second side being opposite to said first side.

6. A push switch according to claim 1, wherein said movable contact includes a dome-shaped portion projecting towards a direction opposite to a direction to said fixed plate.

7. A push switch according to claim 6, wherein at least one of a slit and an aperture is formed around said dome-shaped portion.

8. A push switch according to claim 1, further comprising an insulating film provided on said contact plate at an opposite side to a side facing said fixed plate.

* * * * *